US005464134A

United States Patent [19]

Rennie

[11] Patent Number: 5,464,134

[45] Date of Patent: Nov. 7, 1995

[54] SQUEEZE LUBE WITH A CLOSURE DEVICE RESILIENTLY URGED TOWARD CLOSED POSITION

[75] Inventor: Patrick Rennie, Morristown Ship, N.J.

[73] Assignee: Cosmoplast, Annecy, France

[21] Appl. No.: 206,258

[22] Filed: Mar. 7, 1994

[30] Foreign Application Priority Data

Mar. 5, 1993 [FR] France ..... 93 02593

[51] Int. Cl.[6] ..... B67D 3/00

[52] U.S. Cl. ..... 222/507; 222/518

[58] Field of Search ..... 222/507, 509, 222/518, 520, 521, 554, 548

[56] References Cited

U.S. PATENT DOCUMENTS

| | | | |
|---|---|---|---|
| 2,838,214 | 6/1958 | Kimball | 222/507 X |
| 4,402,434 | 9/1983 | Baker . | |
| 4,964,537 | 10/1990 | Dubach . | |
| 5,096,098 | 3/1992 | Garcia | 222/518 X |
| 5,271,524 | 12/1993 | Marston | 222/507 X |

FOREIGN PATENT DOCUMENTS 0296103 12/1988 European Pat. Off. .

*Primary Examiner*—Gregory L. Huson
*Attorney, Agent, or Firm*—Young & Thompson

[57] ABSTRACT

A closure device for a squeeze tube that is squeezed to expel the contents thereof, the closure device being of the type comprising a first portion provided with a dispensing orifice and a second portion provided with a stud suitable for co-operating with the dispensing orifice in order to close it and also to open it; the first and second portions are associated with each other on a permanent basis while still being capable of being displaced one relative to the other. The stud is continuously urged towards its closed position by a resilient member. According to the invention, the first portion comprises a sealed thrust device suitable for acting against the resilient member in the stud-opening direction so that in the closed position the stud closes the dispensing orifice under drive from the resilient member, the thrust device then being inactive, while in the open position, the stud opens, the dispensing orifice under drive from the thrust device.

12 Claims, 3 Drawing Sheets

SQUEEZE LUBE WITH A CLOSURE DEVICE RESILIENTLY URGED TOWARD CLOSED POSITION

The invention relates to a closure device for a tube that is squeezed to expel the contents of the tube.

BACKGROUND OF THE INVENTION

Several types of device exist for closing tubes that are designed to be squeezed and enabling the contents thereof to be expelled.

U.S. Pat. No. 4,625,081 or FR-A-2 591 571 relate to receptacle shutters including a cap constituted by a side wall and by a top wall, which cap is fixed to an outlet piece by means of a hinge joint. Locking is provided by releasable snap engagement of the cap on the outlet piece. The outlet piece comprises a transverse top wall that includes a dispensing orifice which co-operates with a spur formed on the inside face of the top wall of the cap.

FR-A-2 293 372 relates to a closure having a pivoting spout including a plug fixed on the receptacle and a spout mounted to rotate on the plug between a closed position in which the spout closes an orifice in the plug and an open position in which the spout extends the orifice in the plug. The axis of rotation is perpendicular to the general axis of the plug.

EP-A-0 336 188 also relates to a closure having a pivoting spout, the difference compared with the closure described in FR-A-2 253 372 being that the axis of rotation is parallel to the general axis of the plug.

EP-A-0 296 103 relates to a dispensing capsule comprising a base suitable for mounting on the neck of a receptacle and including a pouring opening, and connected thereto a spout that is closed at its top end and that serves as a sealing peg. The capsule further includes a covering hood connected in rotary manner to the base and including a central opening into which, when the capsule is in the closed position, the closed top end penetrates so as to achieve sealing. The covering hood is mounted to rotate axially by means of an outside thread on the top end engaging in an inside thread formed in the covering hood. Such a device suffers from the drawback of the need to provide a top end of axial length that is sufficient to enable an outside thread to be formed thereon. That causes the capsule to have considerable axial extent, particularly relative to the tube on which it is mounted. One of the major consequences of this drawback is that the consumer can be mislead as to how much substance a tube that has just been acquired genuinely contains.

FR-A-2 560 158 relates to a dispensing capsule having a safety key and comprising a capsule body with a bottom skirt including a rod for engaging the receptacle, a central notch having an angled end, and a top opening for dispensing the contents of the receptacle. The capsule body is provided on the inside with a shaft on which a spring blade is mounted that forms a panel for closing the top opening and the angled notch. The end of the spring blade constitutes a drive lever inside the notch. The capsule of that document, which is considered as being the state of the art closest to the present invention, suffers from several drawbacks. Firstly, said capsule is dedicated to a particular type of receptacle that must initially be prepared to receive the drive lever, so the capsule is therefore non-standard and cannot be mounted on receptacles that have not been so prepared. Secondly, the tolerances that the spring blade can accept are very small since it serves to close two orifices simultaneously, one of which is not dedicated to expelling the contents of the receptacle.

OBJECTS AND SUMMARY OF THE INVENTION

An object of the present invention is to mitigate the above-mentioned drawbacks by proposing a device of the same type as the above capsule but which is standard in that it is suitable for fitting to existing receptacles without modification and which does not include an orifice to be closed other than orifices for expelling content, while nevertheless being made as safe as the above-described capsule.

To this end, the present invention provides a closure device for a squeeze tube enabling the contents of said tube to be expelled, the device being of the type comprising a first portion provided with a dispensing orifice, a second portion provided with a stud suitable for co-operating with the dispensing orifice for the purpose of closing it and also of releasing it, the first and second portions being permanently associated one with the other while still being capable of being displaced relative to each other between a closed position and an open position in which, respectively, the stud is in a closed position where it closes the orifice and an open position where it releases it, a user being capable of causing the device to change between said two positions, the stud being urged continuously towards its closed position by a resilient member. According to the invention, the first portion includes sealed thrust means suitable for acting directly or indirectly on the stud and the resilient member independently of the tube and against the resilient member, in the stud-opening direction; such that in the closed position the stud closes the dispensing orifice under drive from the resilient member, the thrust means then being inactive, and in the open position, the stud releases the dispensing orifice under drive from the thrust means.

The advantage of the present invention is based on the fact firstly that the operation of the device is independent of the tube on which it is mounted, and secondly the thrust means give rise to no leakage.

BRIEF DESCRIPTION OF THE DRAWINGS

Other advantages appear from the following description given with reference to the accompanying drawings, in which.

MORE DETAILED DESCRIPTION

Figure 1:
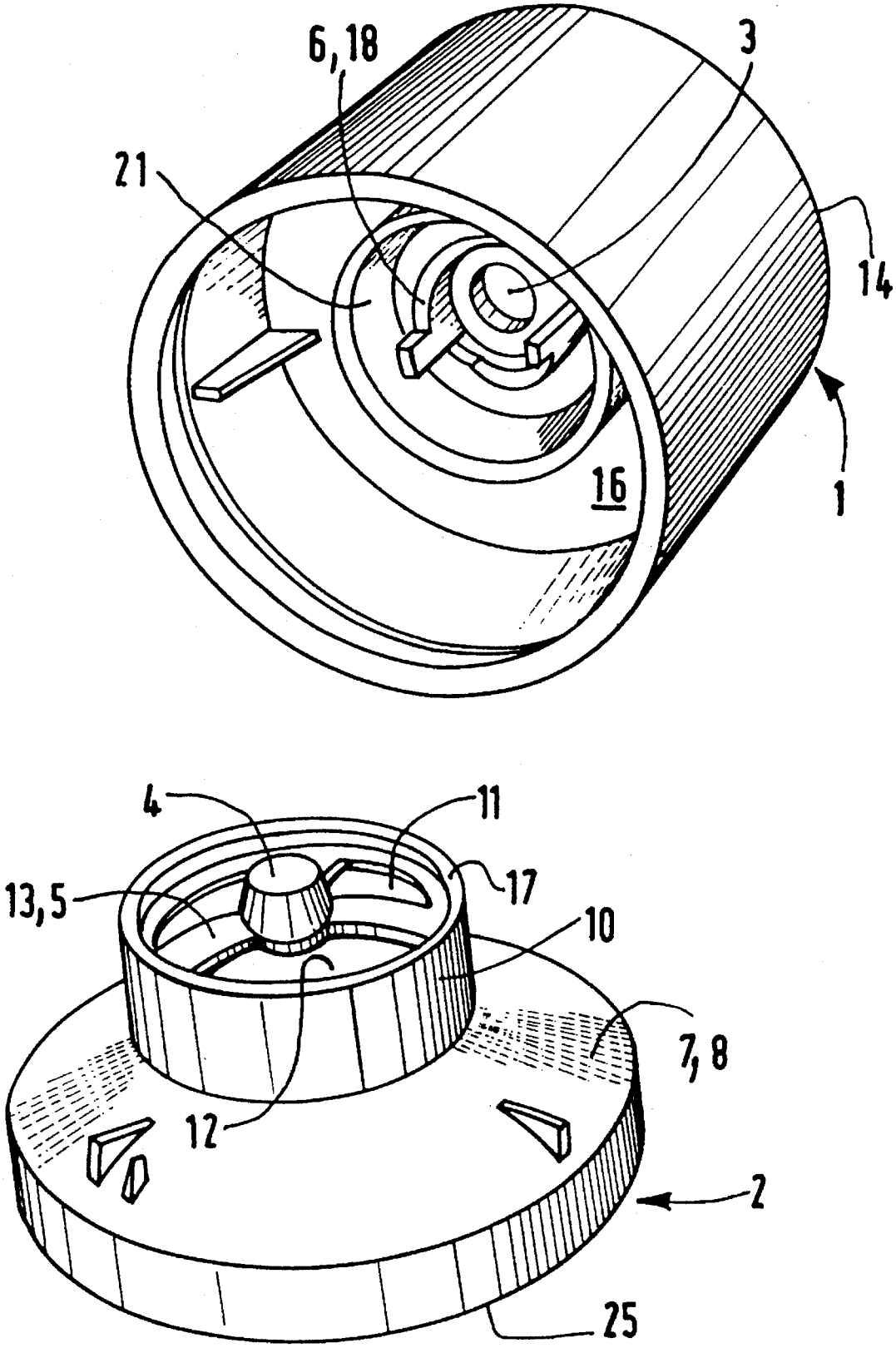
FIG. 1 is an exploded diagrammatic end view of a closure device constituting a first preferred embodiment of the invention.

The closure device of the invention is designed to be fitted to a squeeze tube 9 enabling the contents of the tube to be expelled. To this end, the closure device moves between a closure first position in which the squeeze tube 9 is sealed relative to the outside, and an opening second position in which the contents of the tube 9 can be expelled to the outside. To do this, the device comprises two portions 1, 2 that are permanently associated with each other while being capable of being displaced one relative to the other in order to go from the closed position to the open position, and vice versa.

The first portion 1 is provided with a dispensing orifice 3 through which the contents of the tube 9 flows when in the open position. The second portion 2 is provided with a stud 4 suitable for co-operating with the dispensing orifice 3 in order to shut it in the closed position with assistance from a resilient member 5 urging the stud 4 into the dispensing orifice 3.

The first portion 1 includes thrust means 6 suitable for bearing directly or indirectly on the stud 4 and the resilient member 5 so that in the open position they oppose the urging of the resilient member 5, thereby causing the stud 4 to release the dispensing orifice 3. The thrust means are inactive when the device is in its closed position. The thrust means 6 are disposed and organized in such a manner as to be sealed, i.e. to give rise to no leakage from the assembly comprising the tube and the closure device. They are located inside the device and do not project outside it in any way.

In preferred embodiments of the invention, the second portion 2 forms an inner cover 7 comprising an annular or frustoconical base 8 that, in the assembled position, covers the base of the tube 9, together with a collar 10 extending the base 8. The collar 10 provides a passage 11 for the contents of the tube 9 and has a through opening 12 remote from the base 8. In preferred embodiments of the invention, but in non-limiting manner, the collar 10 includes an inside thread 19 for co-operating with thread on the neck of the tube 9. In other embodiments, these items could be associated, in non-limiting manner, by snap-fastening, welding, or even co-molding of the second portion 2 on the tube 9. Proper operation of the device does not require any special modification of the tube 9. The device functions independently of the tube. Only the means for co-operation between them need to be compatible.

The stud 4 situated in the through opening 12, directed towards the outside and extending along an axis 20 perpendicular to the opening 12 is carried by an elastically deformable part 13 of the second portion 2 which part serves as the resilient member 5. The part 13 which is secured to the second portion 2 being connected thereto close to the edge 17 of the collar 10 does not completely obstruct the opening 12, thus allowing the contents of the tube 9 to pass to the outside. This deformable part 13 urges the stud 4 outwards along the axis 20 of the stud.

The first portion 1 comprises a transverse end wall 15 in which the dispensing orifice 3 is formed. When the device is in the assembled position, the transverse wall 15 is in permanent contact via its inside face 16 with the edge 17 of the collar 10. This permanent contact provides sufficient sealing to prevent unwanted passage of the contents of the tube 9 between the portion 1 and the portion 2. In the closed position, the dispensing orifice 3 overlies and has the same axis as the stud 4 which is designed to close it. The thrust means 6 may, in non-limiting manner, extend from the transverse end wall, the essential point being that they remain in the sealed space between the first and second portions.

In preferred embodiments of the invention, the two portions are generally circularly symmetrical about a common axis 26, the first portion being snapped by force onto the second portion by co-operation between a bush 21 placed on the inside face 16 of the transverse end wall 15 of the first portion and a ring 22 extending the edge 17 of the collar on the second portion 2, and by co-operation between an annular projection 23 disposed inside the skirt 24 of the first portion and an annular abutment 25 of the base 8 of the second portion. As a result, the two portions 1 and 2 are sealed relative to each other and they are permanently associated with each other while still being free to rotate relative to each other about their axis of symmetry 26. The thrust means 6 are then disposed on the inside face 16 of the transverse end wall, between the axis of symmetry 26 and the bush 21.

Figure 2:
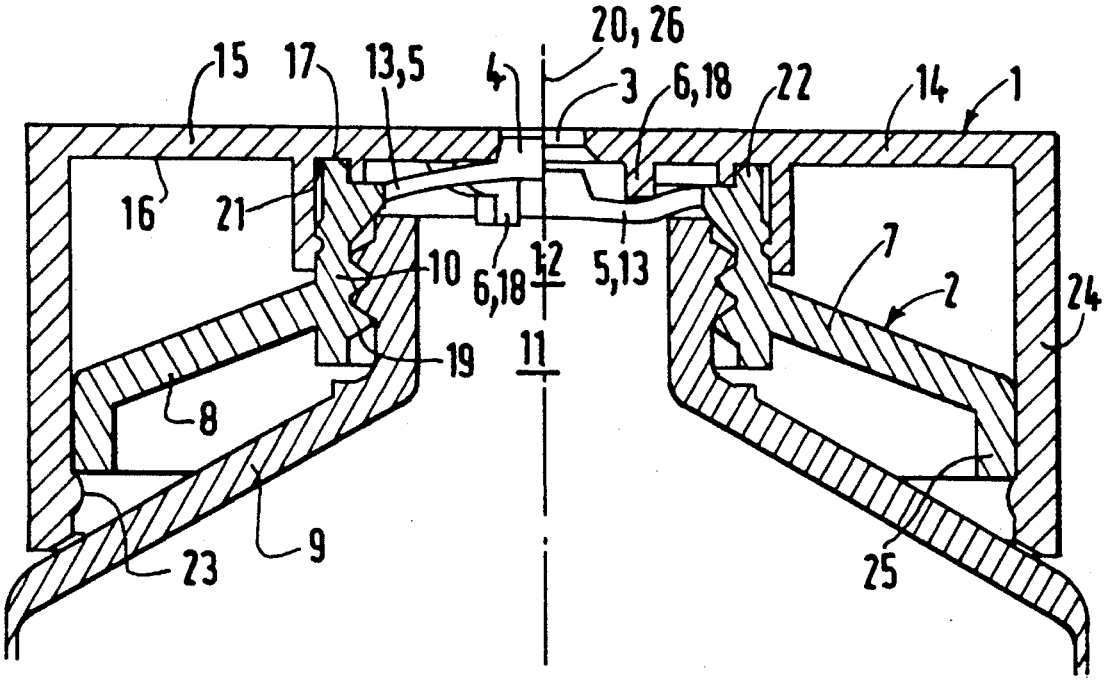
FIG. 2 comprises two diagrammatic half-views in section of the FIG. 1 device in the closed position and in the opened position.

In the first preferred embodiment of the invention (FIGS. 1 and 2) the dispensing orifice 3 of the first portion is centered on the axis of symmetry 26 of the component portions 1 and 2 of the device. Similarly, the stud is centered on the axis of symmetry 26 of the portions 1 and 2 and it penetrates into the orifice 3 under urging from the star-shaped elastically deformable part 13. The branches of the star (there preferably being three thereof) extend radially across the opening 12 so as to be connected to the second portion 2 in the vicinity of the edge 17 of the collar 10. The thrust means 6 are constituted by at least one sawtooth projection 18 projecting parallel to the axis from the inside face 16 of the transverse end wall 15 of the first portion 1, extending over a circular arc, and acting directly on the elastically deformable part 13. In this embodiment, when the first portion 1 is rotated relative to the second portion 2, at least one of the branches of the elastically deformable part 13 comes into contact with the sawtooth projection 18. The projection cams the branch so that the stud 4 that was engaged in the orifice 3 is moved away from its closed position towards an open position in which it is no longer engaged in the orifice 3. By applying rotation in the opposite direction, the branch returns to its rest position, forcing the stud 4 back into the orifice 3. To obtain better operation, it is preferable, but not essential, for there to be as many sawtooth projections 18 as there are branches of the star which forms the elastically deformable part 13, said projections being angularly distributed in the same way as the branches of the star. Furthermore, and still for the purpose of improved operation, it is preferable but not essential for the stud 4 to be generally in the form of a truncated cone that engages in an orifice 3 of complementary shape.

Figure 4:
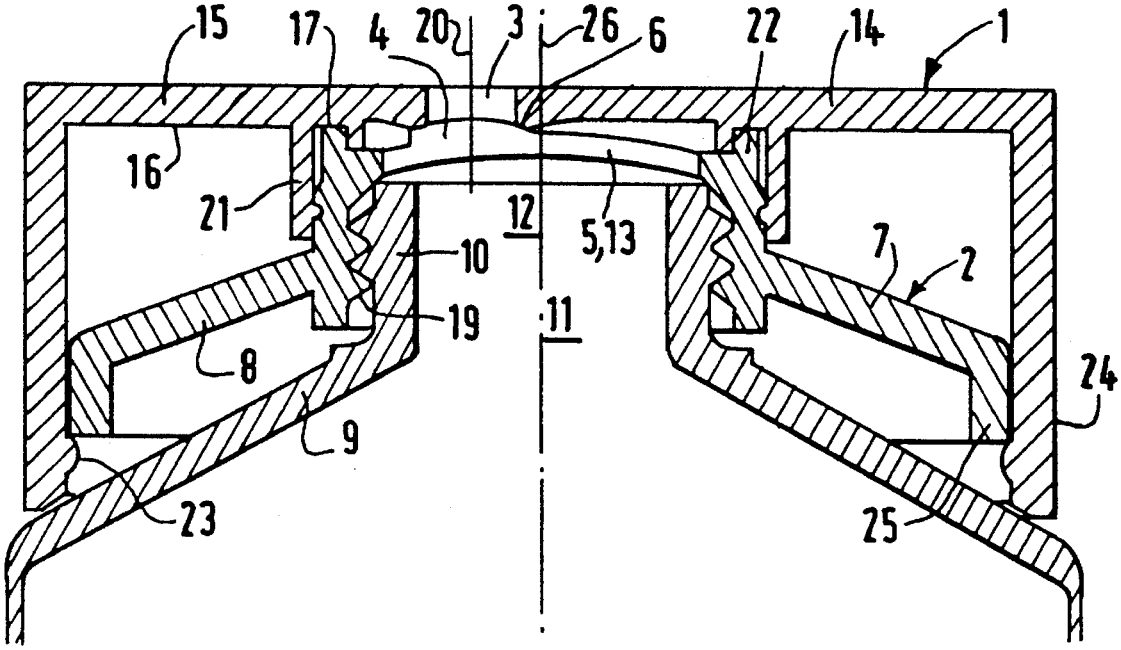
FIG. 4 is a diagrammatic section view of the FIG. 3 device.
Figure 3:
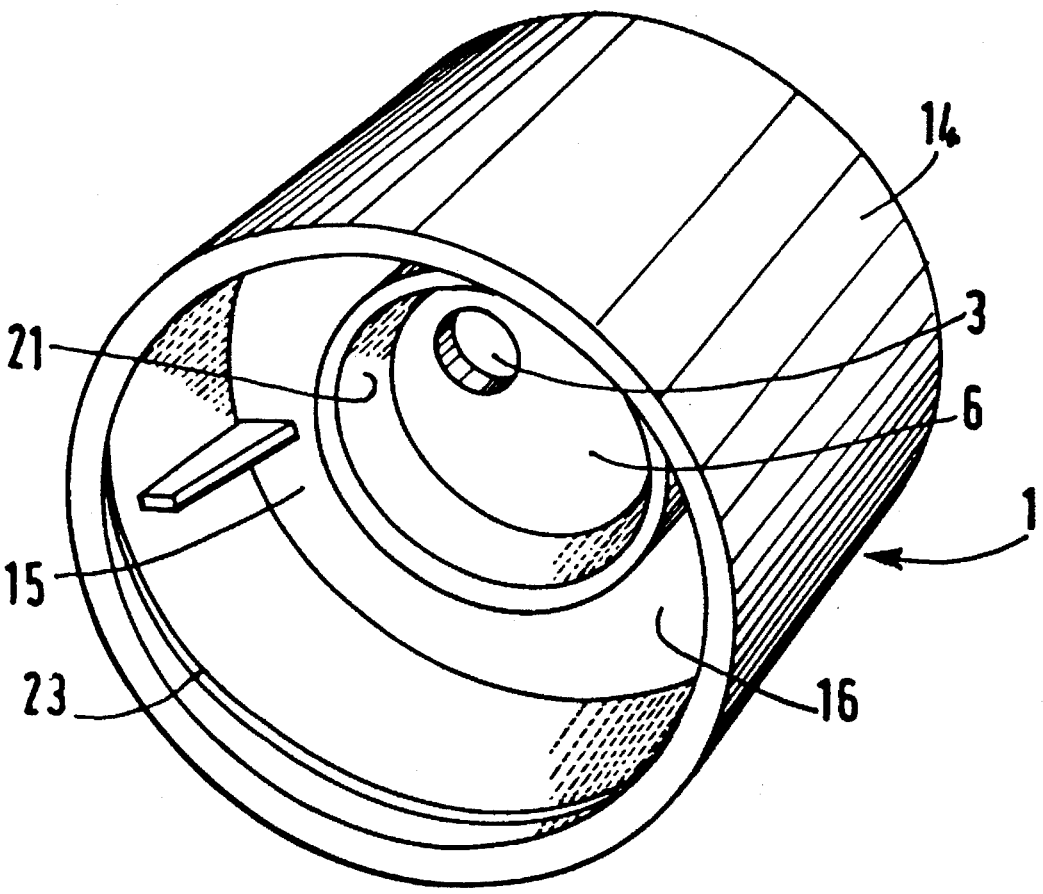
FIG. 3 is an exploded diagrammatic end view of a closure device constituting a second preferred embodiment of the invention.
Figure 3:
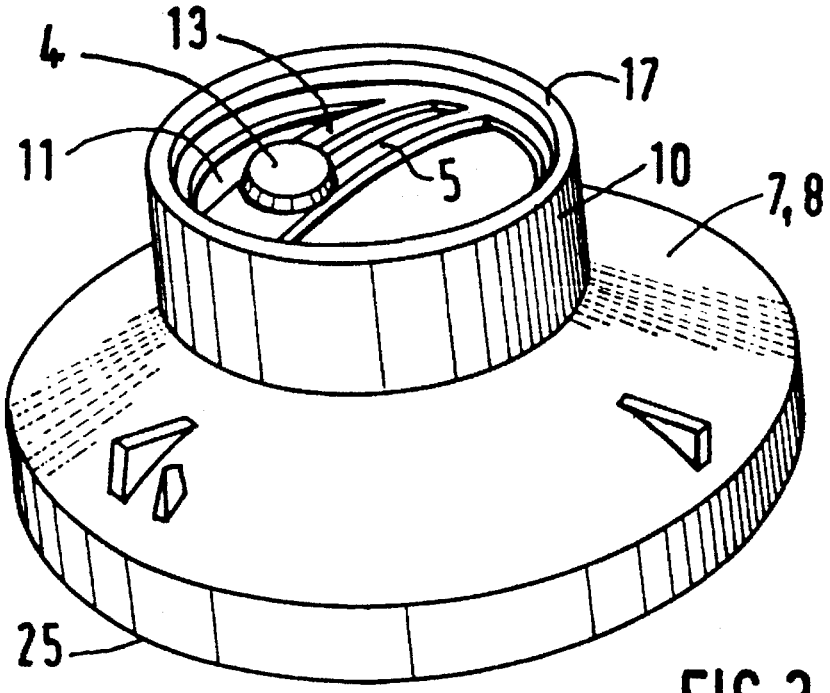

In a second preferred embodiment of the invention (FIGS. 3 and 4), the dispensing orifice 3 of the first portion is eccentric relative to the axis of symmetry 26. Similarly, the stud 4 is eccentric by the same distance as the orifice 3. The stud 4 closing the orifice 3 is carried by an elastically deformable part 13 in the form of a strip that is connected to the second portion 2 in the vicinity of the edge 17 of the collar 10. In this case, the thrust means are the transverse end wall 15 itself acting directly on the stud. By relative rotation of the first portion 1 relative to the second portion 2, the stud 4 which is urged against the transverse end wall 15 by the elastically deformable part 13 disengages from the orifice 3 in an open position, and by relative rotation in the opposite direction it moves back into the orifice 3 in a closed position.

Although only two preferred embodiments of the invention are described above, it is clear that any modification provided by the person skilled in the art in the same spirit does not go beyond the ambit of the present invention. Thus, provision may be made for the first and second portions to be mounted to slide relative to each other along a sliding axis that extends radially relative to the axis of the stud.

I claim:

1. A closure device for a squeeze tube enabling the contents of said tube to be expelled, the device being of the type comprising a first portion provided with a dispensing orifice, a second portion provided with a stud suitable for co-operating with the dispensing orifice for the purpose of closing it and also of opening it, the first and second portions being permanently associated one with the other while still being capable of being displaced relative to each other between a closed position and an open position in which, respectively, the stud is in a closed position where it closes the orifice and an open position where it opens it, a user being capable of causing the device to change between said two positions, the stud being urged continuously towards its closed position by a resilient member, wherein the first portion is substantially rigid and includes sealed thrust means suitable for acting on the stud and the resilient member independently of the tube and against the resilient member, in the stud-opening direction, and the second portion being provided with a through opening such that in the closed position the stud closes the dispensing orifice under drive from the resilient member, the thrust means then being inactive, and in the open position, the stud and the resilient member are situated in the through opening and the stud opens the dispensing orifice under drive from the thrust means.

2. A closure device for a squeeze tube enabling the contents of said tube to be expelled, the device being of the type comprising a first portion provided with a dispensing orifice, a second portion provided with a stud suitable for co-operating with the dispensing orifice for the purpose of closing it and also of opening it, the first and second portions being permanently associated one with the other while still being capable of being displaced relative to each other between a closed position and an open position in which, respectively, the stud is in a closed position where it closes the orifice and an open position where it opens it, the user being capable of causing the device to change between said two positions, wherein the second portion forms an inner cover comprising a base extending the tube and a collar extending the base; the collar being open to form a passage for the contents of the tube; the stud being situated in the through opening of the collar remote from the base and directed towards the outside; the stud being carried by an elastically deformable part of the second portion connected to one of the collar and the base; said elastically deformable part being located in the through opening while leaving the through opening of the collar substantially disengaged, without obstructing it completely; said elastically deformable part constituting a resilient member urging the stud in an axial direction towards the outside of the collar so that in the closed position, the stud under such urging closes the dispensing orifice situated facing it; the first portion being substantially rigid and forming an outer cover engaged on the inner cover; the first portion comprising a transverse end wall in which the dispensing orifice is provided; the transverse end wall being in permanent contact via its inside face with the edge of the collar around its through opening, there being sufficient sealing between them to prevent unwanted passage of the contents of the tube therebetween; the dispensing orifice being situated, in the closed position, axially over the stud which closes it, and in the open position, over the through opening; the first portion including sealed thrust means secured to its transverse end wall and suitable for acting on the stud and the elastically deformable part in such a manner that in the open position the stud subjected to drive from the thrust means acting against the resilient member leaves the dispensing orifice open.

3. A closure device according to claim 1, wherein the first portion is generally cylindrical in shape and the second portion is generally circularly, these portions having a common axis of symmetry and being mounted to rotate one relative to the other about their common axis of symmetry.

4. A closure device according to claim 1, wherein the first and second portions are mounted to slide one relative to the other along a sliding axis extending radially relative to the axis of the stud.

5. A closure device according to claim 1, wherein the first and second portions are associated with each other by means of a snap-fastening.

6. A closure device according to claim 2, wherein the thrust means are situated above the resilient member or the stud are constituted by the inside face of the transverse end wall of the first portion.

7. A closure device according to claim 6, wherein the thrust means act directly on the stud.

8. A closure device according to claim 2, wherein the thrust means are constituted by at least one sawtooth projection projecting parallel to the axis and perpendicular to the dispensing orifice, from the inside face of the transverse end wall of the first portion.

9. A closure device according to claim 8, wherein the thrust means act directly on the elastically deformable member.

10. A closure device according to claim 3, wherein the stud and the orifice are centered on the axis of symmetry.

11. A closure device according to claim 3, wherein the stud and the orifice are eccentric relative to the axis of symmetry.

12. A closure device according to claim 1, wherein said device is so associated with the tube (2) that the second portion (L) is an integral part of the tube (9).

* * * * *

UNITED STATES PATENT AND TRADEMARK OFFICE

CERTIFICATE OF CORRECTION

PATENT NO. : 5,464,134

DATED : November 7, 1995

INVENTOR(S) : Patrick RENNIE

It is certified that error appears in the above—identified patent and that said Letters Patent is hereby corrected as shown below:

On title page, item [54] and column 1, line 2,
change "LUBE" to --TUBE--.

Signed and Sealed this

Thirtieth Day of January, 1996

Bruce Lehman

*Attest:*

BRUCE LEHMAN

*Attesting Officer*

*Commissioner of Patents and Trademarks*